US005520736A

United States Patent [19]

Long et al.

[11] Patent Number: 5,520,736

[45] Date of Patent: May 28, 1996

[54] VENT BLOCK FOR FLAME SPRAY COATING SYSTEM

[75] Inventors: Lloyd Long, Knott; Mark Dobek, Big Spring, both of Tex.

[73] Assignee: Plastic Flamecoat Systems, Inc., Big Spring, Tex.

[21] Appl. No.: 374,137

[22] Filed: Jan. 18, 1995

[51] Int. Cl.[6] ..... B05B 7/14; B05B 7/24; B05B 7/32

[52] U.S. Cl. ..... 118/308; 118/309; 239/426; 239/434; 239/418; 239/398; 239/335; 239/336

[58] Field of Search ..... 118/308, 309; 239/8, 79, 83, 426, 434, 418, 398, 335, 336

[56] References Cited

U.S. PATENT DOCUMENTS

| | | | |
|---|---|---|---|
| 3,333,774 | 8/1967 | DeMaison | 239/335 |
| 3,438,579 | 4/1969 | Wiese | 239/85 |
| 3,453,134 | 7/1969 | Haw | 118/309 |
| 3,472,201 | 10/1969 | Quackenbush | 118/308 |
| 3,658,302 | 4/1972 | Duthion et al. | 239/434 |
| 3,918,401 | 11/1975 | Blakeslee | 118/630 |
| 4,018,185 | 4/1977 | Myers | 118/308 |
| 4,632,309 | 12/1986 | Reimer | 239/8 |
| 4,640,310 | 2/1987 | Hartle et al. | 137/883 |
| 4,795,094 | 1/1989 | Correard | 118/308 |
| 4,934,595 | 6/1990 | Reimer | 239/8 |
| 5,116,321 | 5/1992 | Gelain | 118/308 |
| 5,119,989 | 6/1992 | Kamis | 239/8 |
| 5,282,573 | 2/1994 | Reimer | 239/85 |
| 5,297,733 | 3/1994 | Burks et al. | 239/85 |

FOREIGN PATENT DOCUMENTS 812601 4/1959 United Kingdom .

*Primary Examiner*—Jill Warden
*Assistant Examiner*—Alexander Markoff
*Attorney, Agent, or Firm*—Ross, Clapp, Korn & Montgomery

[57] ABSTRACT

A vent block for use in controlling powder surging in a flame spray coating system having a flame spray gun with an eductor disposed inside the gun, the vent block being disposed between the powder source and the gun, the vent block having intersecting powder and vent air flow paths communicating with an outlet flow path, the cross-sectional areas of the powder and vent air flow paths being substantially equal to each other, and the combined cross-sectional areas of the powder and vent air flow paths being about one half the cross-sectional area of the outlet flow path.

12 Claims, 3 Drawing Sheets

VENT BLOCK FOR FLAME SPRAY COATING SYSTEM

BACKGROUND OF THE INVENTION

1. Field of the Invention

This invention relates to systems useful for flame spraying powdered materials primarily comprising thermoplastic polymeric resins, and more particularly, to a vent block that prevents surging when utilized in such systems.

2. Description of Related Art

Methods and apparatus useful for flame spraying powdered plastic resins onto substrates have previously been disclosed, for example, in U.S. Pat. Nos. 4,632,309; 4,934,595; and 5,282,753. In U.S. Pat. No. 5,282,753, a flame spray coating system is disclosed that utilizes an eductor disposed below a powder hopper for entraining plastic powder in a stream of conveying air. The entrained powder is carried by the conveying air through a flexible delivery hose to a flame spray gun which contacts the powder with a flame to soften the plastic before propelling it against the substrate being coated.

More recently, a flame spray gun has been developed that utilizes an eductor disposed inside the gun to draw the powdered plastic material through a flexible delivery hose from a supply canister to the gun. Such a flame spray gun is disclosed, for example, in U.S. Pat. No. 5,297,733. Difficulties were initially experienced in using this gun because of surging in the powder delivery rate that occurred even though the air flow rate through the eductor remained substantially constant.

SUMMARY OF THE INVENTION

The apparatus disclosed herein has been found to alleviate surging in powder delivery systems used to supply powder to flame spray guns having an eductor disposed inside the gun. According to one preferred embodiment of the invention, a vent block is provided that can be mounted inside a powder supply canister and that comprises an air vent port adapted to draw ambient air into the vent block for mixing with the powder as the powder is drawn into the powder delivery line by the eductor in the flame spray gun.

According to another preferred embodiment of the invention, the subject vent block is disposed between a powder source and the gun, and comprises intersecting powder and vent air flow paths communicating with an outlet flow path, the cross-sectional areas of the powder and vent air flow paths being substantially equal to each other, and the cross-sectional area of the outlet flow path being about twice as large as the combined cross-sectional areas of the powder and vent air flow paths.

According to one particularly preferred embodiment of the invention, the subject vent block comprises a powder suction port, an ambient air vent port, and an outlet port for combined powder and air. The powder suction port and the ambient air vent port preferably communicate with each other and with the outlet port through a plurality of flow channels disposed inside the vent block. A powder flow channel and an air flow channel, both also disposed inside the vent block, preferably intersect and form an outlet flow channel prior to reaching the outlet port. The powder suction port and the powder flow channel together form the inlet powder flow path. The air vent port and the air flow channel together form the inlet air flow path. The outlet flow channel and the outlet port together form the outlet flow path. The sum of the minimum cross-sectional areas of the inlet powder flow path and the inlet air flow path inside the vent block is preferably equal to about one half the cross-sectional area of the outlet flow path, which is also desirably about equal to the cross-sectional area of the hose or conduit that delivers the combined air and powder stream to the eductor inside the flame spray gun. The cross-sectional area of the outlet flow path is preferably determined by the size of the delivery hose and the desired flow rate to the gun, and the preferred diameter for the inlet powder flow path and inlet air flow path are thereafter determined accordingly. The powder flow channel and the air flow channel are most preferably of substantially equal length and also preferably each comprise at least two perpendicular channel segments.

While the apparatus of the invention is disclosed herein in relation to its preferred application in the delivery of powdered materials comprising a major portion of powdered thermoplastic resin, it is believed that the apparatus of the invention is similarly useful for avoiding surging while drawing liquids through a hose or conduit under vacuum.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
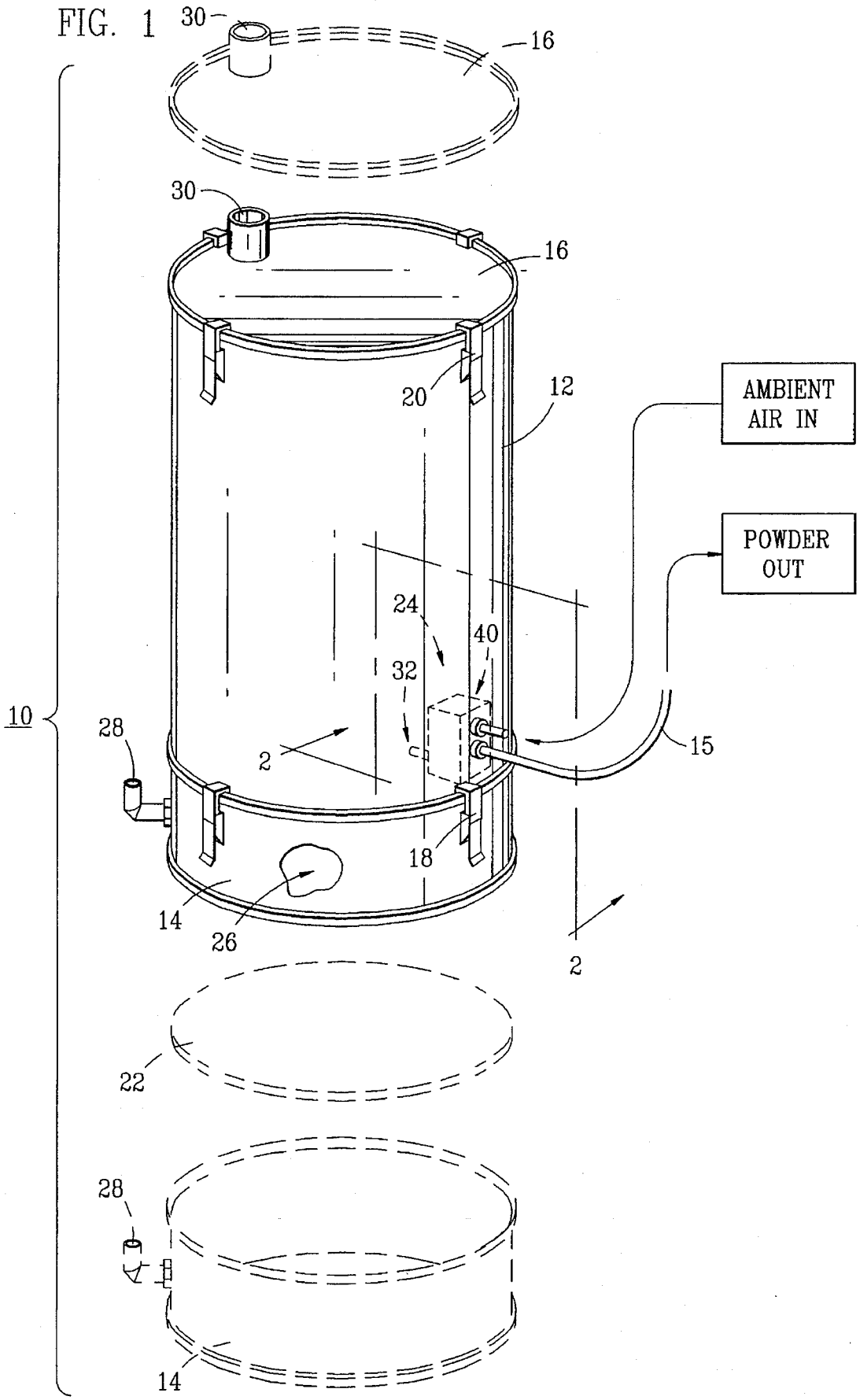
FIG. 1 is a perspective view of a powder supply canister showing in hidden outline a preferred vent block of the invention disposed inside the canister.

The preferred embodiments of the vent block disclosed herein are described in relation to a powder supply canister from which powdered material such as a powdered thermoplastic resin composition can be supplied through a flexible hose to a flame spray gun. Referring to FIG. 1, powder supply canister 10 preferably comprises cylindrical sidewall section 12, cylindrical bottom section 14, circular lid 16, and vent block 40. Flexible powder delivery hose 15 is connected to vent block 40. Latches 18 are provided to releasably attach cylindrical sidewall section 12 to cylindrical bottom section 14, and latches 20 are provided to releasably attach circular lid 16 to cylindrical sidewall section 12. Foraminous board 22 is desirably disposed between cylindrical sidewall section 12 and cylindrical lower section 14 to partition the interior of powder supply canister 10 into an upper powder storage section 24 and a lower air plenum section 26. Foraminous board 22 is a commercially available "fluidizing board" having a plurality of vertically extending pores distributed across its surface that are sufficiently large to permit pressurized air introduced into plenum section 26 through pressurized air inlet port 28 to rise upwardly through foraminous board 22 and fluidize the powder above it, but small enough that no substantial amount of the powder can sift downwardly into plenum section 26.

After a powdered material is introduced into powder storage section 24 through filler port 30, the powder remains inside plenum storage section 24 until the flame spray coating system is activated. As a blower (not shown) forces air into plenum section 26, the pressurized air passes upwards through board 22, preferably causing the powdered material inside powder storage section 24 to "bubble" gently. Although the use of a fluidizing board is not required for the present invention, it has been discovered that a minor degree of powder fluidization is desirable, particularly near the bottom of powder storage section 24, to insure a continuous supply of powder to vent block 40. The use of a fluidizing board is most desirable whenever the powder disposed inside powder supply canister 10 has a high angle of repose or a tendency to clump or cake as powder is withdrawn from near the bottom of powder storage section 24. Alternatively, if needed and desired, a rotating stirrer or a vibratory means can similarly be provided to prevent vent block 40 from "starving" for powder during operation. As seen in hidden outline in FIG. 1, vent block 40 is a rectangular metal block mounted inside cylindrical sidewall section 12 of powder supply canister 10, and receives powder from powder storage section 24 through a powder inlet port communicating with powder inlet stem 32.

Figure 2:
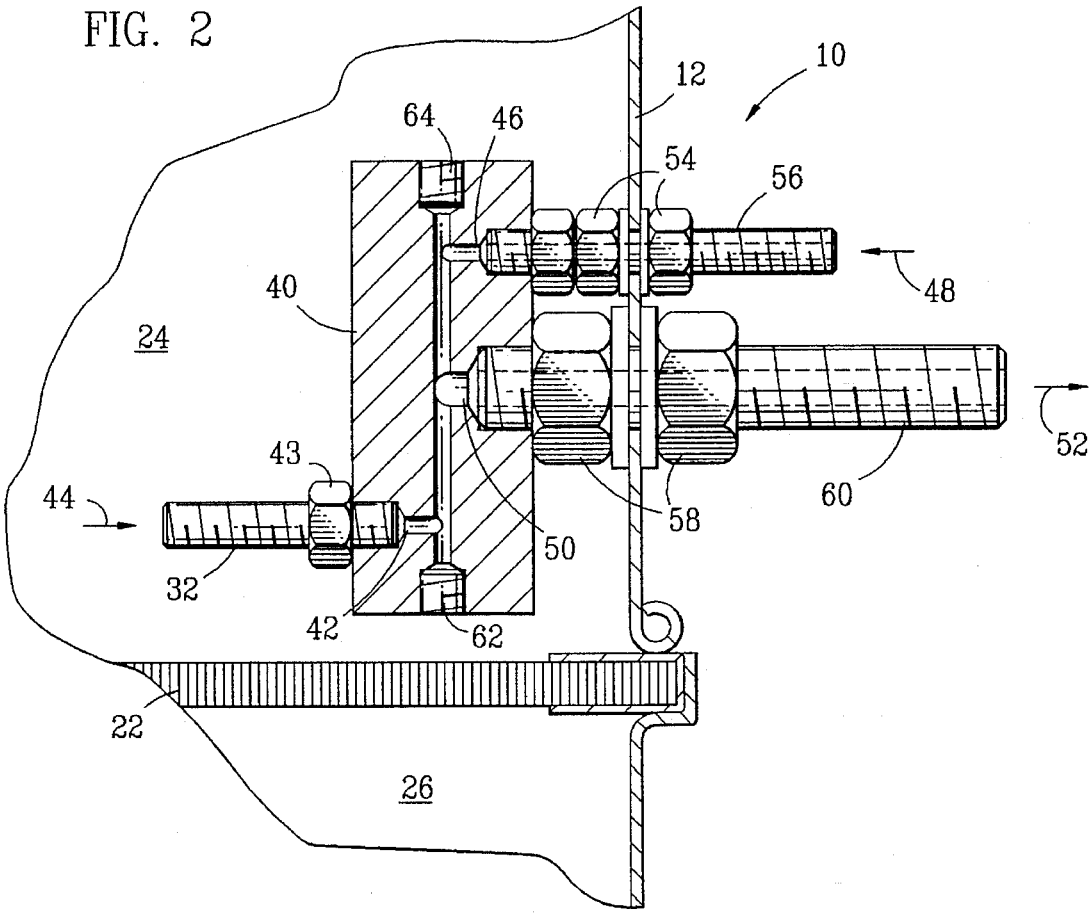
FIG. 2 is an enlarged cross-sectional elevation view of a preferred vent block of the invention taken along line 2—2 of FIG. 1.

Referring to FIG. 2, vent block 40 is preferably mounted near the bottom of cylindrical sidewall section 12 of powder supply canister 10 and slightly above foraminous board 22 that partitions the interior of powder supply canister 10 into powder storage section 24 and plenum section 26. Powder inlet stem 32 is preferably threaded into powder suction port 42 and releasably secured by nut 43. Air vent stem 56 is preferably threaded into vent port 46. Outlet stem 60 is preferably threaded into outlet port 50. Nuts 54 on air vent stem 56 and nuts 58 on outlet stem 60 are desirably used to secure vent block 40 to cylindrical sidewall section 12. Arrow 44 indicates the direction of powder flow into vent block 40 from powder storage section 24. Arrow 48 indicates the direction of ambient air flow into vent block 40 from outside powder supply canister 10. Arrow 52 indicates the direction of combined powder and ambient air flow out of powder supply canister 10 into hose 15 as seen in FIG. 1. Vent block 40 is preferably made from a unitary metal block, most preferably aluminum, into which the flow channels as described below are bored using conventional drilling techniques. Plugs 62, 64 are provided to seal off drilling ports creating during fabrication of vent block 40.

Figure 3:
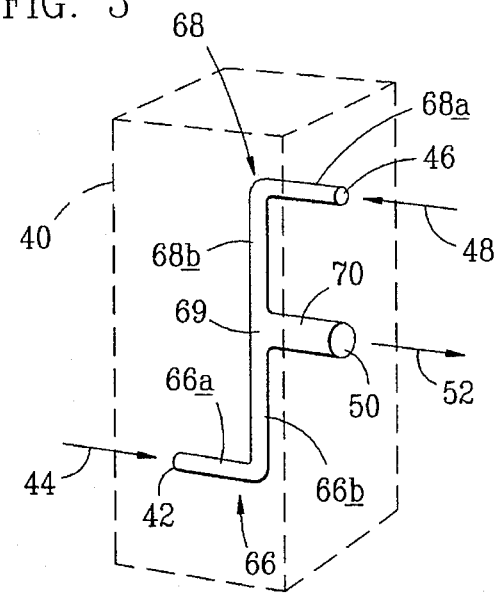
FIG. 3 is a simplified diagrammatic perspective view illustrating the inlet powder flow path, the inlet air flow path and the outlet flow path through the vent block of FIGS. 1 and 2.

The flow channels in vent block 40 are more easily seen in the diagrammatic representation in FIG. 3 wherein powder flow channel 66 communicates with powder suction port 42 and further comprises perpendicular channel segments 66*a*, 66*b*; wherein air flow channel 68 communicates with vent port 46 and further comprises perpendicular channel segments 68*a*, 68*b*; and wherein outlet flow channel 70 communicates with outlet port 50. Powder flow channel 66 and air flow channel 68 preferably intersect at entrance 69 to outlet flow channel 70. According to a particularly preferred embodiment of the invention, the length and cross-sectional areas of powder flow channel 66 and air flow channel 68 are substantially equal, the cross-sectional areas of powder flow channel 66 and air flow channel 68 are substantially constant, and the sum of the cross-sectional areas of powder flow channel 66 and air flow channel 68 is about one half the cross-sectional area of outlet flow channel 70. The cross-sectional area of outlet flow channel 70 is preferably substantially equal to the cross-sectional area of hose 15 of FIG. 1. Powder inlet stem 32, air vent stem 48 and outlet stem 60 preferably each comprise a cylindrical longitudinal bore having a cross-sectional area substantially equal to the cross-sectional areas of powder flow channel 66, air flow channel 68 and outlet flow channel 70, respectively. The lengths of powder inlet stem 32 and air vent stem 48 are also preferably substantially equal, and if not, are desirably included in determining the overall length of powder flow channel 66 and air flow channel 68, respectively. The use of a broken, non-linear flow path preferably formed by a plurality of perpendicularly oriented flow channel segments, most preferably two or three channel segments each for powder flow channel 66 and air flow channel 68, is desirable when using a powder supply canister 10 comprising a fluidized bed because the powder takes on characteristics of a fluid and tends to flow into the vent block. This can effectively alter the relative lengths of the powder and air flow channels, diminishing performance. The use of a non-linear flow path is also believed to contribute to the effectiveness of vent block 40 in controlling surges in the delivery of powdered material through hose 15 even where the powder supply canister does not comprise a fluidized bed. The desirability of using a plurality of perpendicularly disposed channel segments for each of the three flow channels is believed to be greater for larger hopper sizes and for flow paths having shorter lengths and higher diameter to length ratios.

Figure 4:
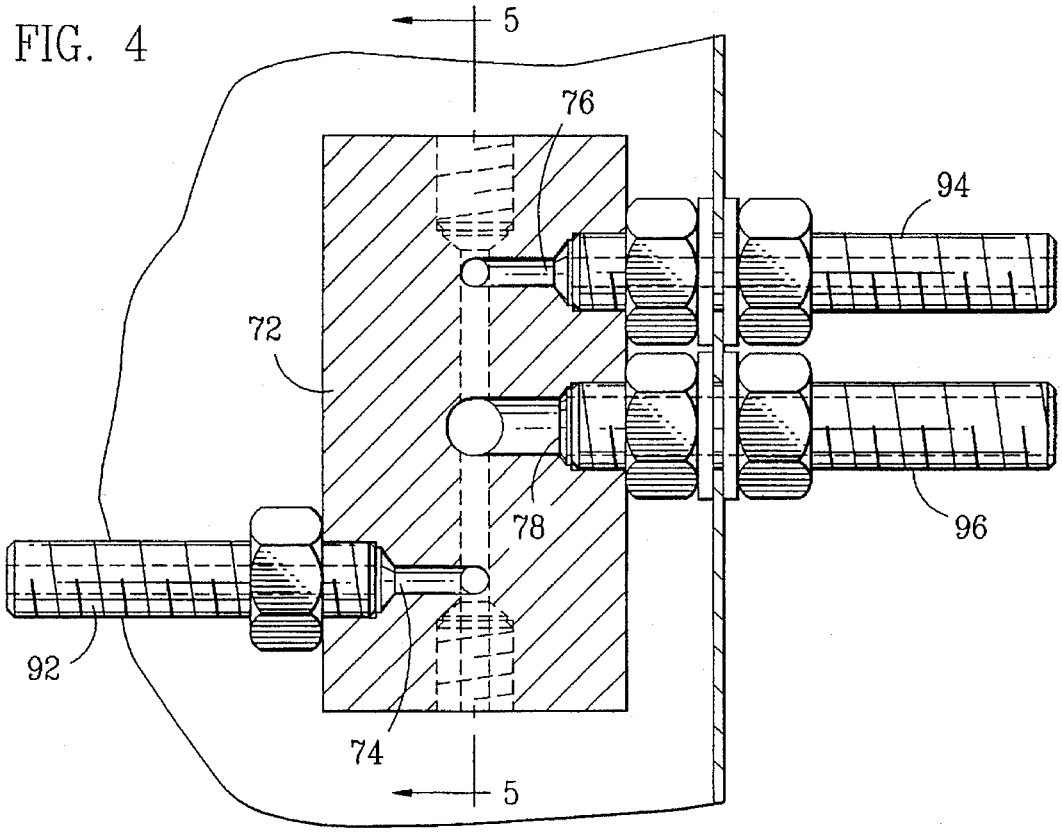
FIG. 4 is an enlarged cross-sectional elevation view of another preferred embodiment of the vent block of the invention.
Figure 5:
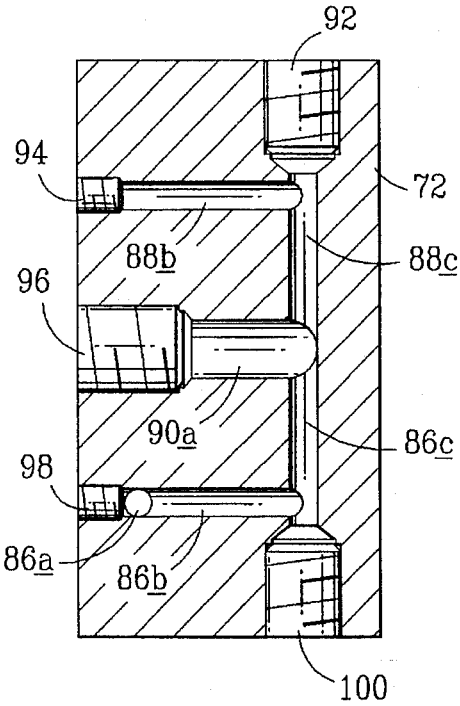
FIG. 5 is a cross-sectional elevation view taken along line 5—5 of FIG. 4.
Figure 6:
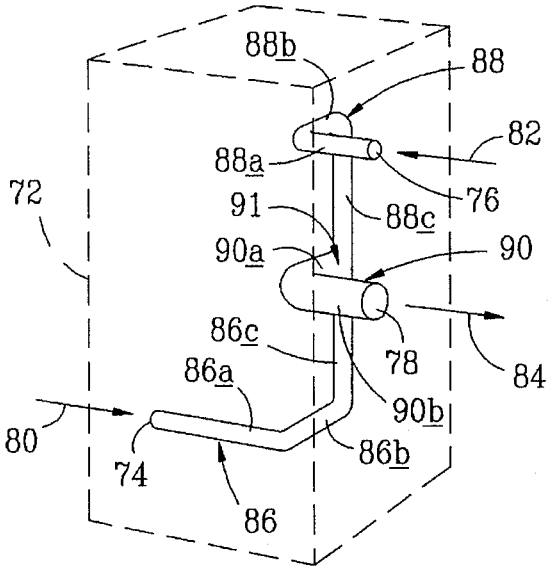
FIG. 6 is a simplified diagrammatic perspective view illustrating the inlet powder flow path, the inlet air flow path and the outlet flow path through the vent block of FIGS. 4 and 5.

A vent block comprising powder and air flow channels each having three perpendicularly disposed channel segments and an outlet flow channel having two perpendicularly disposed channel segments is illustrated and explained in relation to FIGS. 4–6. Referring to FIGS. 4–6, vent block 72 preferably comprises powder suction port 74, vent port 76 and outlet port 78. Powder inlet stem 92 is preferably threaded into powder suction port 74, air vent stem 94 is preferably threaded into vent port 76, and outlet stem 96 is preferably threaded into outlet port 78. Arrow 80 indicates the direction of powder flow into vent block 72, arrow 82 indicates the direction of ambient air flow into vent block 72, and arrow 52 indicates the direction of combined powder and ambient air flow out of vent block 72. The flow channels in vent block 72 are more easily seen in FIGS. 5 and 6 wherein powder flow channel 86 communicates with powder suction port 74 and further comprises perpendicular channel segments 86*a*, 86*b*, 86*c*; wherein air flow channel 88 communicates with vent port 76 and further comprises perpendicular channel segments 88*a*, 88*b*, 88*c*; and wherein outlet flow channel 90 communicates with outlet port 78 and further comprises perpendicular channel segments 90*a*, 90*b*. Powder flow channel 86 and air flow channel 88 preferably intersect at entrance 91 to outlet flow channel 90. According to a particularly preferred embodiment of the invention, the length and cross-sectional areas of powder flow channel 86 and air flow channel 88 are substantially equal, the cross-sectional areas of powder flow channel 86 and air flow channel 88 are substantially constant, and the sum of the cross-sectional areas of powder flow channel 86 and air flow channel 88 is about one half the cross-sectional area of outlet flow channel 90. Powder inlet stem 92, air vent stem 94 and outlet stem 96 preferably each comprise a cylindrical longitudinal bore having a cross-sectional area substantially equal to the cross-sectional areas of powder flow channel 86, air flow channel 88 and outlet flow channel 90, respectively. The lengths of powder inlet stem 92 and air vent stem 94 are also preferably substantially equal, and if not, are desirably included in determining the overall length of powder flow channel 86 and air flow channel 88, respectively.

The use of vent block 40 as disclosed herein is effective in a flame spray coating system having a powder storage canister with a fluidized bed and a capacity of 10 pounds of powder where the inside diameter of the outlet flow channel and delivery hose is about ¼ inch, and where the inside diameter of the powder flow channel and air flow channel are each about ⅛ inch. Using air pressure of from about 100 psi to about 120 psi through the eductor in the flame spray gun of the system, the system delivers powder from the powder supply canister to the gun through hose lengths of up to 50 feet or more without any significant surging.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

I claim:

1. A vent block for use in a flame spray coating system having a powder supply canister connected by a hose with a predetermined cross-sectional area to a flame spray gun with an eductor disposed inside the gun, the vent block being disposed between the powder source and the hose, the vent block comprising:

a powder suction port communicating with the powder supply canister;

a powder flow channel disposed inside the vent block and communicating with the powder suction port;

a vent port communicating with an air vent line extending outside the canister;

an air flow channel disposed inside the vent block, the air flow channel communicating with the vent port and intersecting the powder flow channel;

an outlet port connected to the hose; and an outlet flow channel inside the vent block extending from the point of intersection between the air flow channel and the powder flow channel to the outlet port;

the powder suction port and the powder flow channel having a first minimum cross-sectional area;

the vent port and air flow channel having a second minimum cross-sectional area;

the first minimum cross-sectional area being substantially equal to the second minimum cross-sectional area;

the outlet port and outlet flow channel having a third minimum cross-sectional area substantially equal to the predetermined cross-sectional area; and the sum of the first minimum cross-sectional area and the second minimum cross-sectional area being substantially equal to one half of the third minimum cross-sectional area.

2. The vent block of claim 1 wherein the powder flow channel and the air flow channel each comprise at least two perpendicular channel segments.

3. The vent block of claim 2 wherein the powder flow channel and the air flow channel each comprise three perpendicular channel segments.

4. The vent block of claim 1 wherein the outlet flow channel comprises at least two perpendicular channel segments.

5. The vent block of claim 1 wherein the length of the powder flow channel is substantially equal to the length of the air flow channel.

6. The vent block of claim 1 wherein the powder flow channel, the air flow channel and the outlet flow channel are bored out of a unitary metal block.

7. The vent block of claim 6 wherein the unitary metal block is made of aluminum.

8. In a flame spray coating system having a powder supply canister connected by a hose with a predetermined cross-sectional area to a flame spray gun with an eductor disposed inside the gun, and an improved vent block disposed between the powder source and the hose, the vent block comprising:

a powder suction port communicating with the powder supply canister;

a powder flow channel disposed inside the vent block and communicating with the powder suction port;

a vent port communicating with an air vent line extending outside the canister;

an air flow channel disposed inside the vent block, the air flow channel communicating with the vent port and intersecting the powder flow channel;

an outlet port connected to the hose; and an outlet flow channel inside the vent block extending from the point of intersection between the air flow channel and the powder flow channel to the outlet port;

the powder suction port and the powder flow channel having a first minimum cross-sectional area;

the vent port and air flow channel having a second minimum cross-sectional area;

the first minimum cross-sectional area being substantially equal to the second minimum cross-sectional area;

the outlet port and outlet flow channel having a third minimum cross-sectional area substantially equal to the predetermined cross-sectional area; and the sum of the first minimum cross-sectional area and the second minimum cross-sectional area being substantially equal to one half of the third minimum cross-sectional area.

9. The flame spray coating system of claim 8 wherein the powder flow channel and the air flow channel each comprise at least two perpendicular channel segments.

10. The flame spray coating system of claim 9 wherein the powder flow channel and the air flow channel each comprise three perpendicular channel segments.

11. The flame spray coating system of claim 8 wherein the outlet flow channel comprises at least two perpendicular channel segments.

12. The flame spray coating system of claim 8 wherein the length of the powder flow channel is substantially equal to the length of the air flow channel.

* * * * *